US012589274B2

(12) United States Patent
Godin

(10) Patent No.: US 12,589,274 B2
(45) Date of Patent: Mar. 31, 2026

(54) BRACE SYSTEM FOR RESISTANCE EXERCISES

(71) Applicant: Alexander Godin, Englewood, CO (US)

(72) Inventor: Alexander Godin, Englewood, CO (US)

( * ) Notice: Subject to any disclaimer, the term of this patent is extended or adjusted under 35 U.S.C. 154(b) by 204 days.

(21) Appl. No.: 18/229,894

(22) Filed: Aug. 3, 2023

(65) Prior Publication Data

US 2025/0041652 A1 Feb. 6, 2025

(51) Int. Cl.
*A63B 21/00* (2006.01)

(52) U.S. Cl.
CPC ..... *A63B 21/4017* (2015.10); *A63B 21/4033* (2015.10); *A63B 21/4039* (2015.10); *A63B 2225/09* (2013.01)

(58) Field of Classification Search
CPC ..... A63B 21/4017; A63B 21/4033; A63B 21/4039; A63B 2225/09
See application file for complete search history.

(56) References Cited

U.S. PATENT DOCUMENTS

| | | | | |
|---|---|---|---|---|
| 1,699,219 | A | 1/1929 | Bemish | |
| 3,724,846 | A | 4/1973 | Perrine | |
| 4,629,183 | A | 12/1986 | Perrine | |
| 4,799,675 | A | 1/1989 | Helmer | |
| D360,440 | S | 7/1995 | Banks | |
| 6,616,581 | B2 | 9/2003 | Gwyn | |
| 7,373,678 | B2 * | 5/2008 | Hetzel | A47C 7/021 5/655.4 |
| D696,045 | S * | 12/2013 | Marinkovic | D6/601 |
| 8,771,155 | B1 | 7/2014 | Bell | |
| 10,765,909 | B2 * | 9/2020 | Wiegman | A63B 21/4034 |
| 2008/0096744 | A1 * | 4/2008 | Perry | A61H 1/0218 482/142 |
| 2012/0036698 | A1 * | 2/2012 | Guertin | A63B 63/004 428/57 |
| 2014/0342888 | A1 * | 11/2014 | Cecil | A63B 23/12 482/142 |
| 2022/0258003 | A1 * | 8/2022 | Peterson | A63B 21/4029 |
| 2022/0401784 | A1 | 12/2022 | Beckish | |
| 2023/0398424 | A1 * | 12/2023 | Soller | A63B 23/0233 |
| 2024/0075337 | A1 * | 3/2024 | Reyes | A63B 21/4037 |

FOREIGN PATENT DOCUMENTS

| | | |
|---|---|---|
| WO | WO2021092566 | 5/2021 |

* cited by examiner

*Primary Examiner* — Andrew M Kobylarz

(57) ABSTRACT

A brace system for supporting a user's arms and thighs during resistance exercises includes an arm restraint which is worn on the user's shoulders and which comprises a crossbar and a pair of arm supports. When the arm restraint is worn, the crossbar extends over the user's chest and the arm supports extend over the user's biceps, restraining the user's arms from moving forwardly with respect to the chest past the chest. The brace system further includes a thigh support which is positioned over a ledge of a seat during use and which supports the user's thighs to eliminate extraneous movement from muscles other than the user's quadriceps during a leg exercise.

2 Claims, 8 Drawing Sheets

BRACE SYSTEM FOR RESISTANCE EXERCISES

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to brace apparatuses and more particularly pertains to a new brace apparatus for supporting a user's arms and thighs during resistance exercises.

(2) Description of Related Art Including Information Disclosed Under 37 CFR 1.97 and 1.98

The prior art discloses several arm brace apparatuses for securing an upper arm of a user in an orientation wherein the upper arm extends downwardly along a torso of the user. Such apparatuses include straps which wrap around a chest and each upper arm of a user and rigid braces which wrap around the chest and support each upper arm from behind. But the prior art does not describe such an apparatus wherein the apparatus attaches to the user via shoulder straps, includes a crossbar which extends over the chest, and which restrains the upper arms on a front side over the biceps of the user. Such an apparatus would provide an alternative to the brace apparatuses of the prior art and allow the user to freely move the upper arms rearwardly of the user's torso.

The prior art also does not disclose such an apparatus which also includes a thigh support that may be removably positioned on a ledge of a seat to support the user's thighs along a full length of the thigh, including adjacent to a rear side of a knee joint of the user. Such a thigh support would better isolate the user's quadriceps than the seat alone in an exercise focused on strengthening the quadriceps, because many seats of leg exercise equipment support less than the full length of the thigh, permitting undesirable movement of the leg from contractions of the hamstring and other muscles besides the quadriceps.

BRIEF SUMMARY OF THE INVENTION

An embodiment of the disclosure meets the needs presented above by generally comprising an arm restraint apparatus comprising a crossbar, a pair of arm supports, and a pair of straps. The crossbar is elongated between a pair of ends and has a chest engagement surface which extends between the pair of ends and is configured to be positioned against a chest of a user. Each arm support of the pair of arm supports is coupled to an associated end of the pair of ends of the crossbar and has an arm engagement surface which faces a same direction as the chest engagement surface of the crossbar faces. The arm engagement surface of each arm support of the pair of arm supports is configured to be positioned against a front surface of an associated arm of a pair of arms of the user such that the associated arm is restrained from moving forwardly with respect to the chest. The pair of straps is coupled to the crossbar, and each strap of the pair of straps forms a closed loop with the crossbar. Each strap of the pair of straps is positioned such that the pair of straps is configured to mount the crossbar to a pair of shoulders of the user.

Another embodiment of the disclosure generally comprises a brace system which includes the arm restraint apparatus described above and a leg support apparatus. The leg support apparatus comprises a thigh support and a calf support. The thigh support has a pair of recesses extending into an upper surface of the thigh support. The recesses of the pair of recesses are laterally spaced from each other, and each recess of the pair of recesses is configured to receive an associated thigh of a pair of thighs of the user. The calf support is coupled to and extends downwardly from a front edge of the thigh support wherein the leg support is configured to extend over a ledge of a seat of an exercise machine. A front surface of the calf support is positioned such that the front surface is configured to engage a pair of calves of the user when the pair of thighs of the user is positioned over the thigh support. The calf support defines a pair of depressions which are laterally spaced from each other, and each depression of the pair of depressions is configured to receive an associated calf of the pair of calves.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
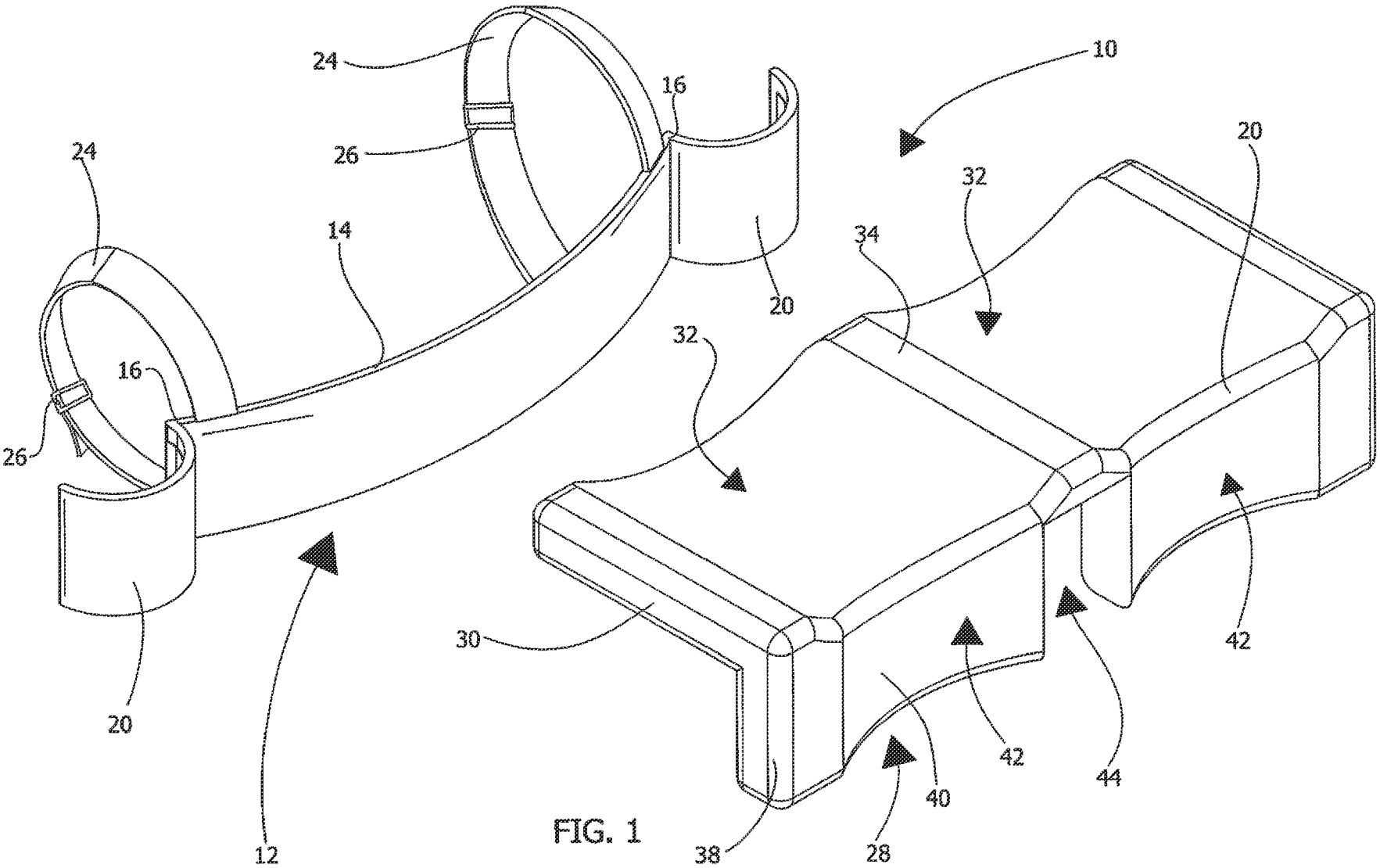
FIG. 1 is a perspective view of a brace system according to an embodiment of the disclosure.
Figure 2:
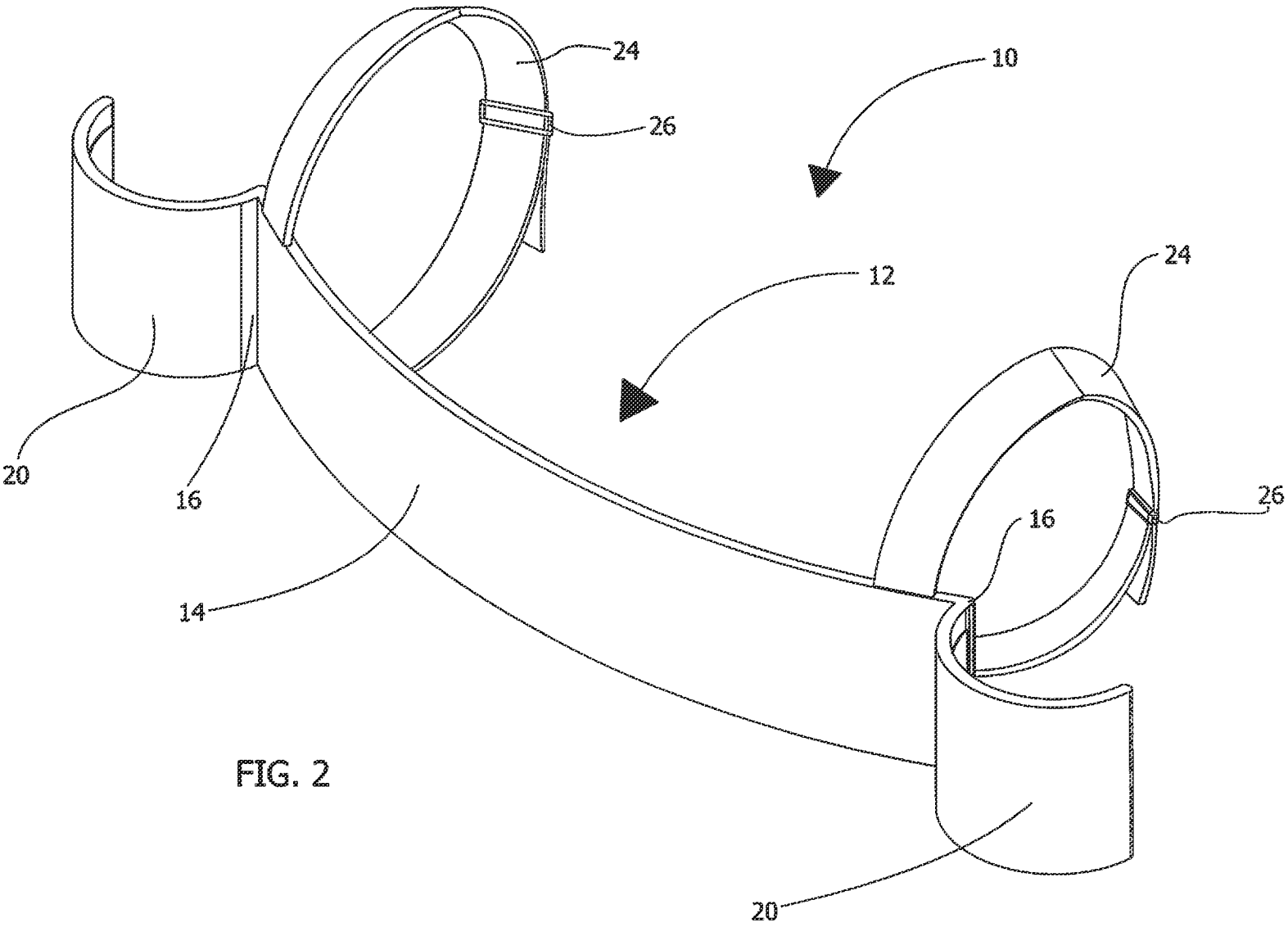
FIG. 2 is a top front side perspective view of an arm restraint of an embodiment of the disclosure.
Figure 3:
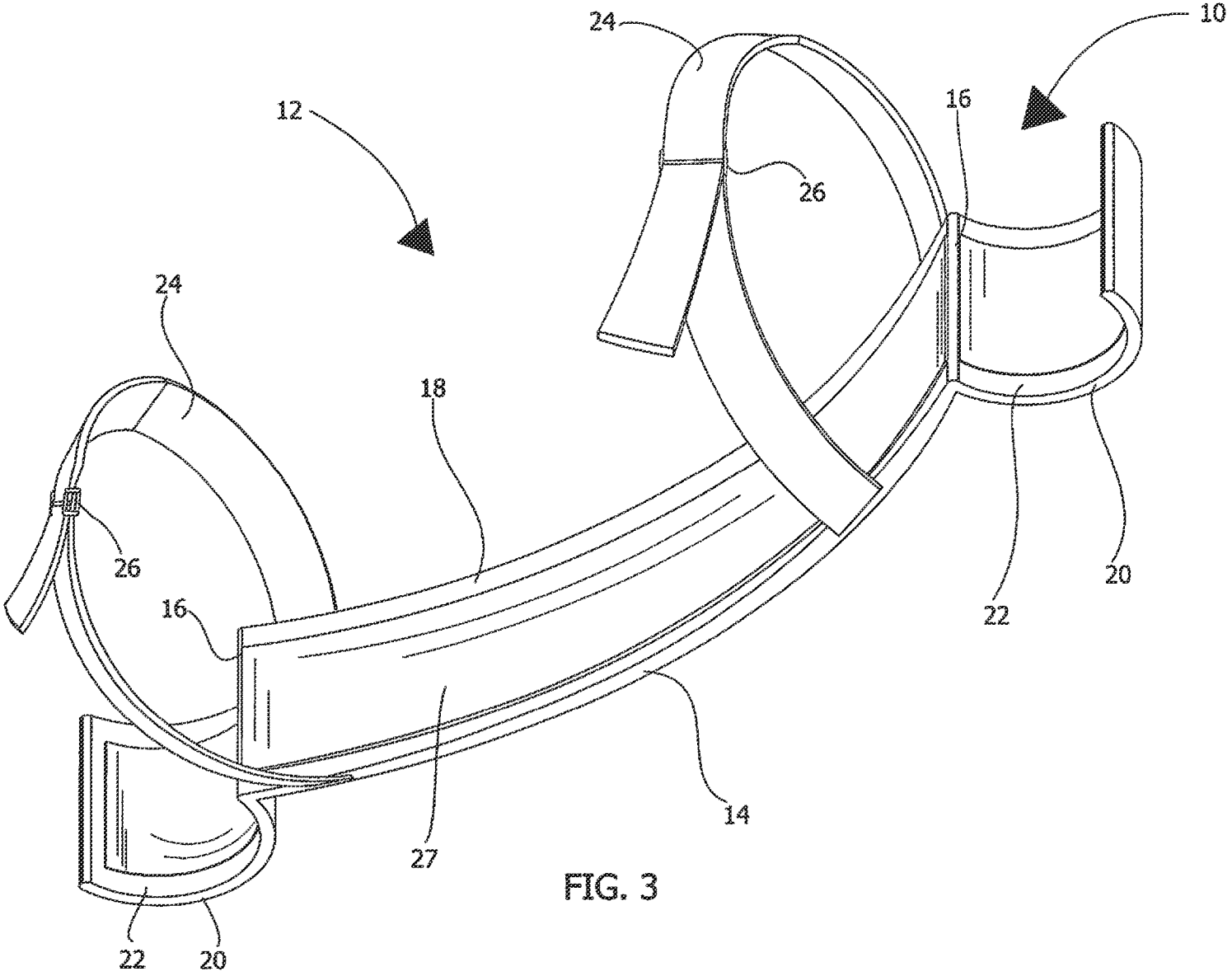
FIG. 3 is a bottom rear side perspective view of the arm restraint of an embodiment of the disclosure.
Figure 4:
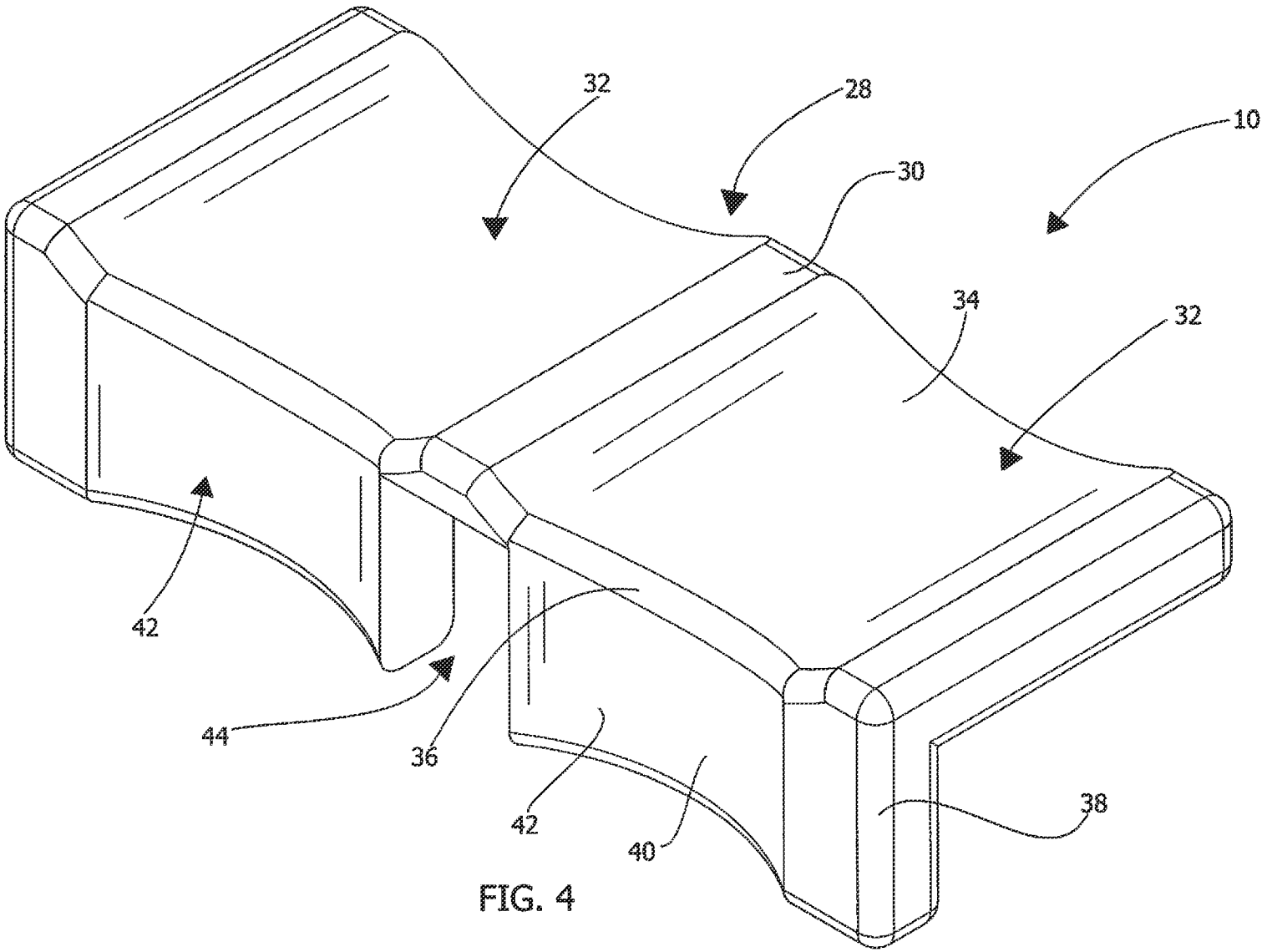
FIG. 4 is a top front side perspective view of a leg support of an embodiment of the disclosure.
Figure 5:
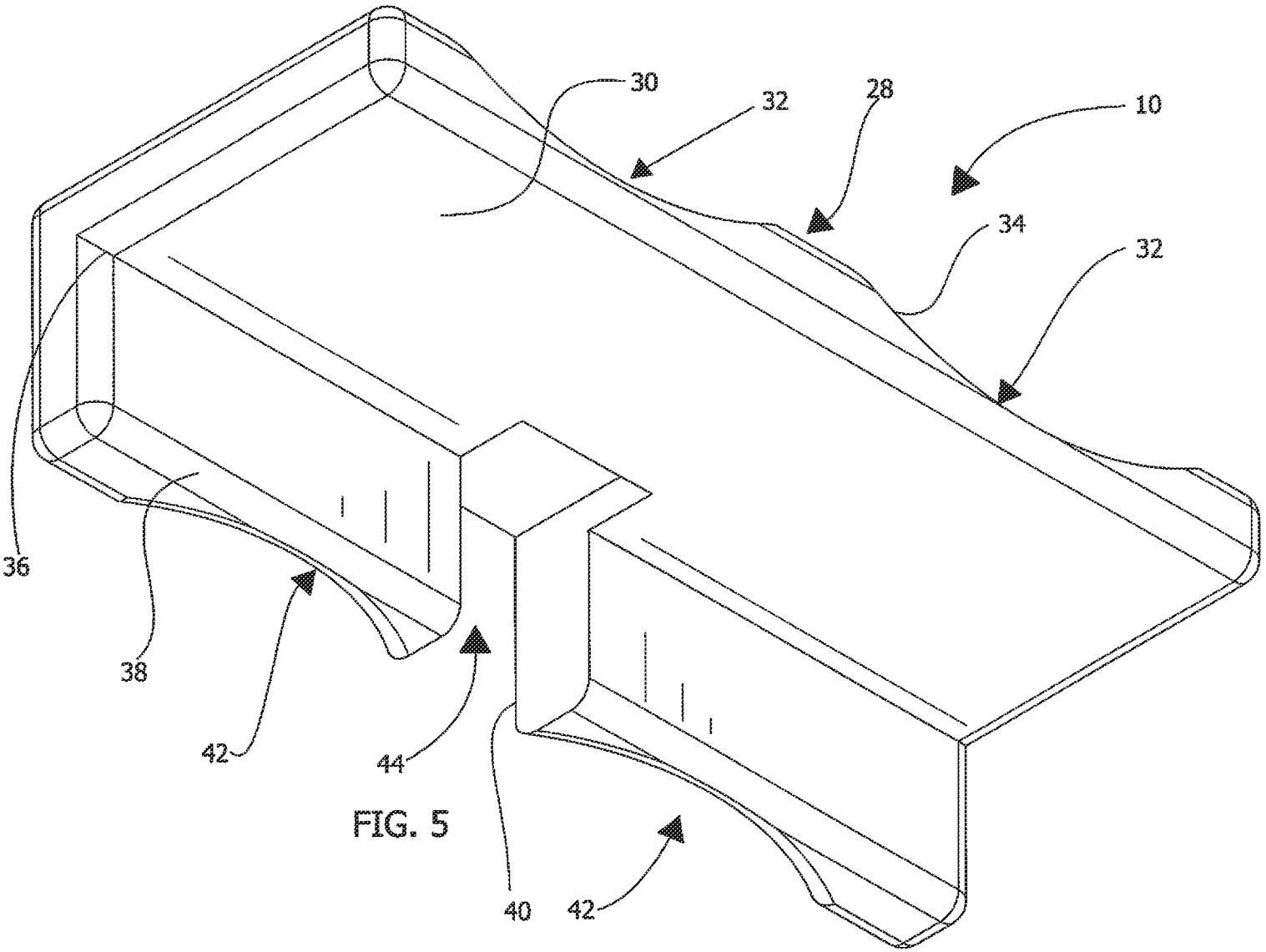
FIG. 5 is a bottom rear side perspective view of the leg support of an embodiment of the disclosure.
Figure 6:
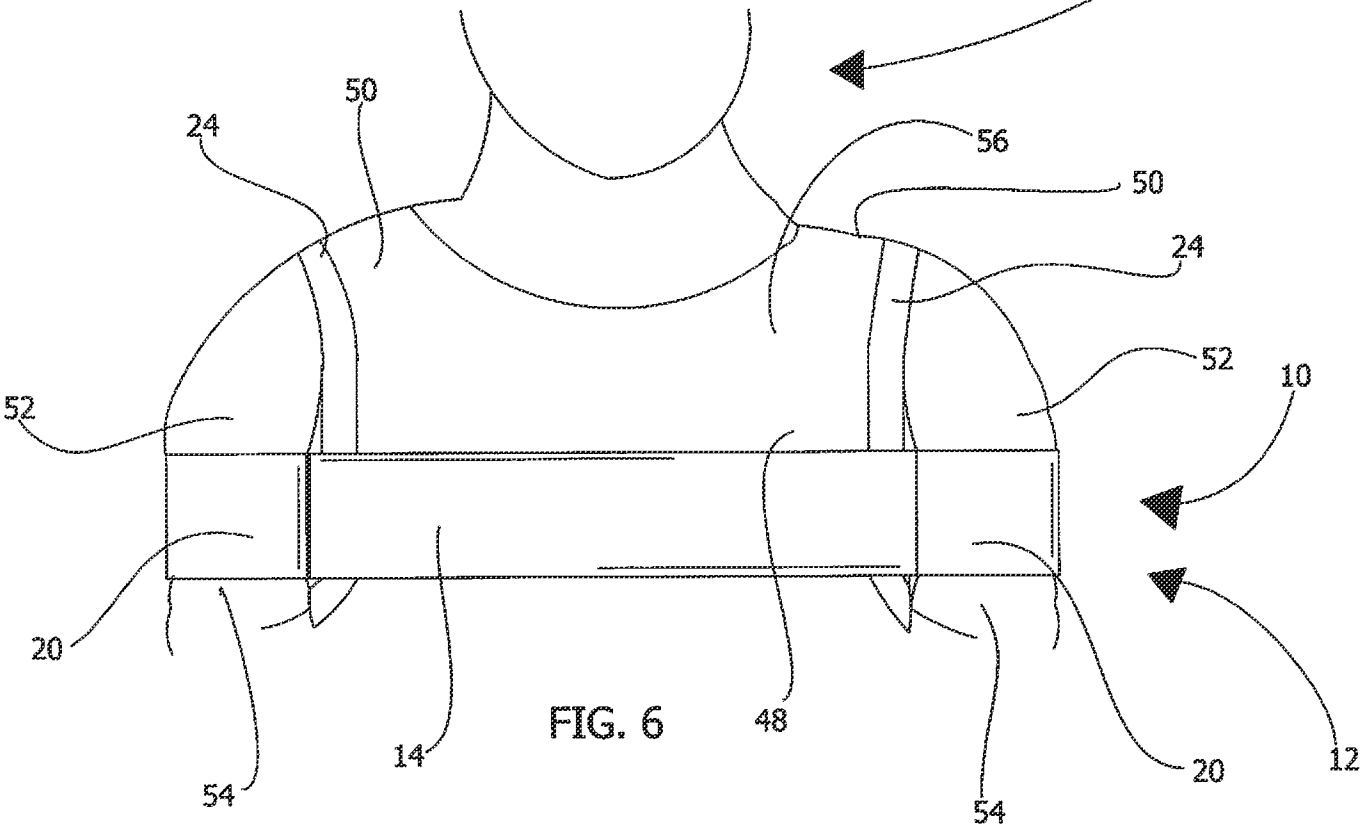
FIG. 6 is a front in-use view of the arm restraint of an embodiment of the disclosure.
Figure 7:
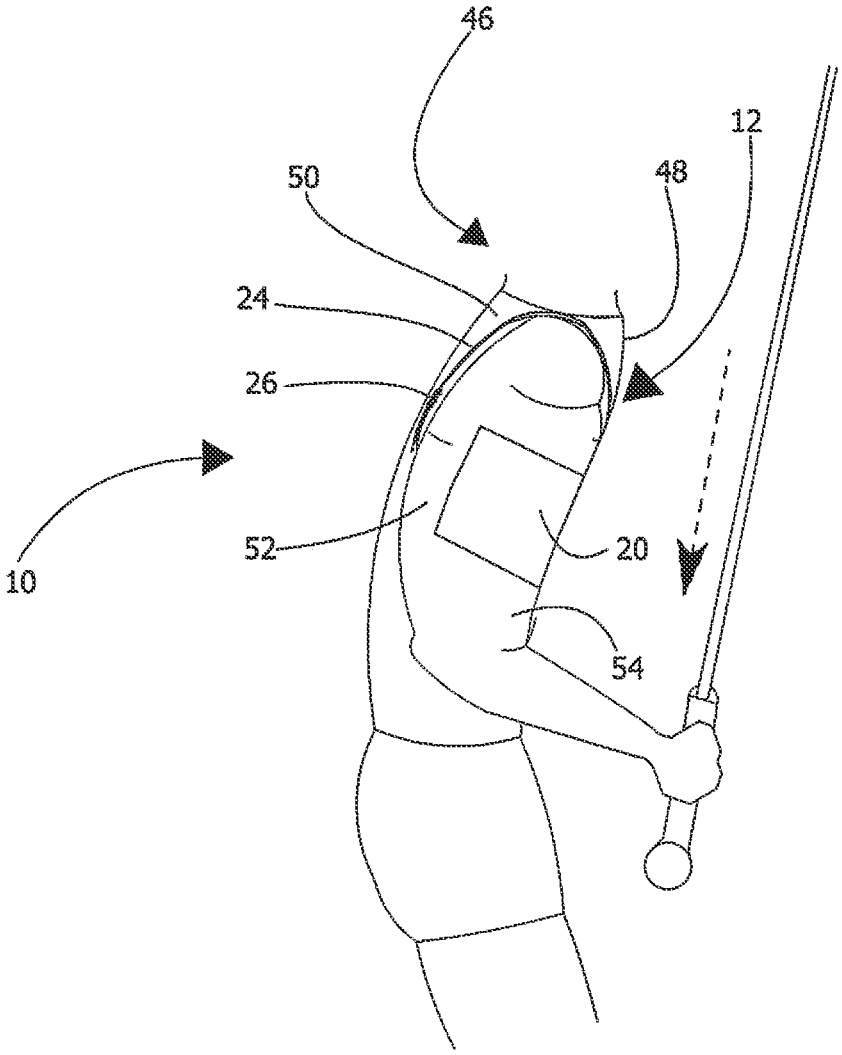
FIG. 7 is a side in-use view of the arm restraint of an embodiment of the disclosure.
Figure 8:
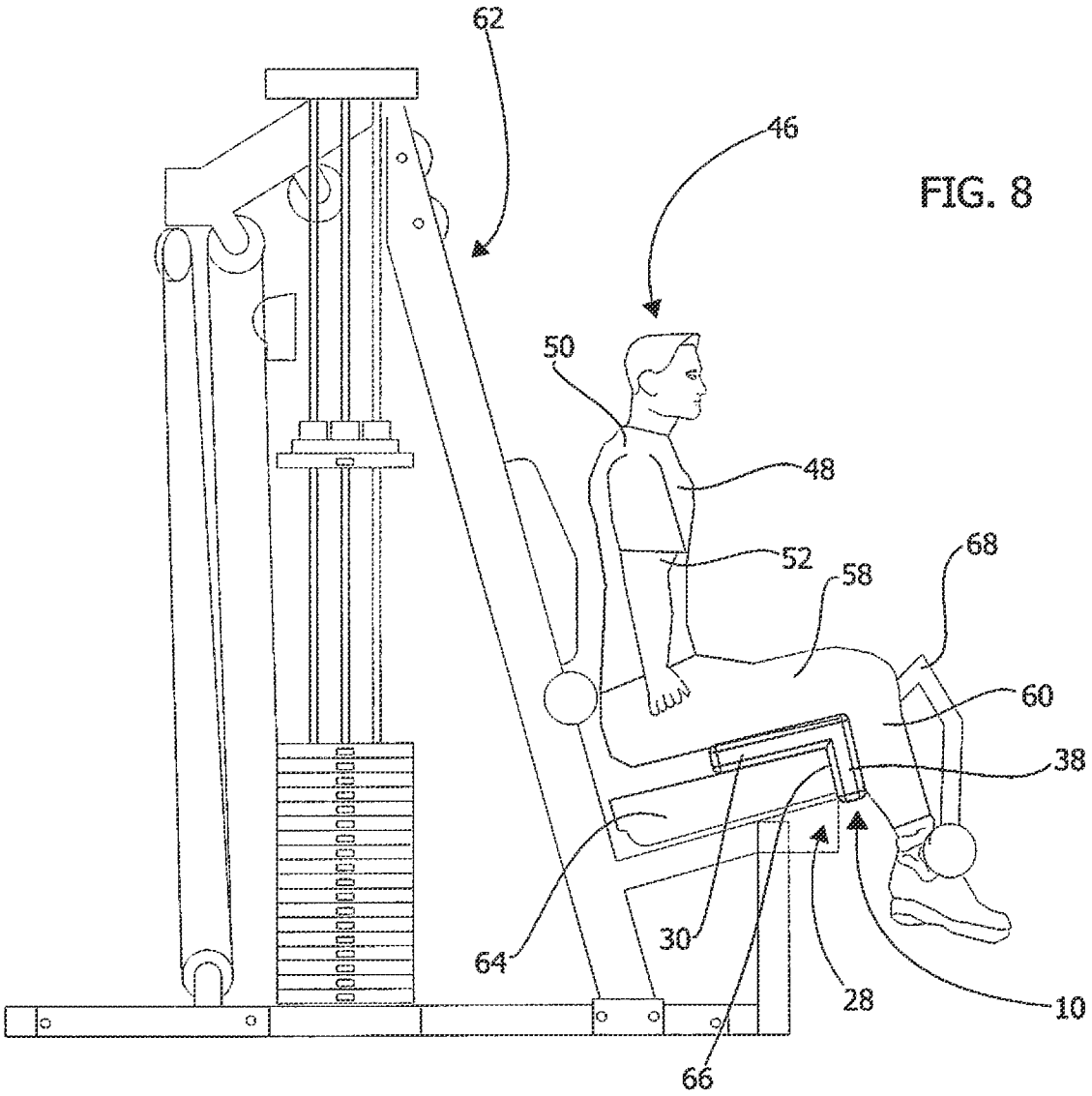
FIG. 8 is a side in-use view of the leg support of an embodiment of the disclosure.

With reference now to the drawings, and in particular to FIGS. 1 through 8 thereof, a new brace apparatus embodying the principles and concepts of an embodiment of the disclosure and generally designated by the reference numeral 10 will be described.

As best illustrated in FIGS. 1 through 8, the brace system 10 generally comprises an arm restraint 12 comprising a crossbar 14, a pair of arm supports 20, and a pair of straps 24. The crossbar 14 is elongated between a pair of ends 16 and has a chest engagement surface 18 extending between the pair of ends 16. The chest engagement surface 18 is configured to be positioned against a chest 48 of a user 46. Each arm support 20 of the pair of arm supports 20 is coupled to an associated end 16 of the pair of ends 16 of the crossbar 14. Each arm support 20 of the pair of arm supports 20 has an arm engagement surface 22 which faces a same direction as the chest engagement surface 18 of the crossbar 14 faces. The arm engagement surface 22 of each arm support 20 of the pair of arm supports 20 is configured to be positioned against a front surface 54 of an associated arm 52 of a pair of arms 52 of the user 46. The front surface 54 of each arm 52 of the pair of arms 52 is defined as the portion of the arm 52 proximate to the biceps of the arm 52 and opposite the triceps of the arm 52. Each arm support 20 of the pair of arm supports 20 is configured to restrain the associated arm 52 from moving forwardly with respect to the chest 48 when the arm engagement surface 22 of the arm support 20 engages the front surface 54 of the associated arm 52.

The chest engagement surface 18 is concavely arcuate. The arm engagement surface 22 of each arm support 20 of the pair of arm supports 20 is also concavely arcuate, and a curvature of the arm engagement surface 22 of each arm support 20 of the pair of arm supports 20 is greater than a curvature of the chest engagement surface 18 of the crossbar 14. The pair of arm supports 20 is integrally formed with the crossbar 14 and comprises a rigid material such that the pair of arms 52 of the user 46 may be effectively restrained as described. The rigid material may comprise, for example, a steel, another metal, a polymer, or other like material.

The pair of straps 24 is coupled to the crossbar 14. Each strap 24 of the pair of straps 24 forms a closed loop with the crossbar 14 and is positioned such that the pair of straps 24 is configured to mount the crossbar 14 to a pair of shoulders 50 of the user 46. Each buckle 26 of a pair of buckles 26 is mounted to an associated strap 24 of the pair of straps 24 such that an inner dimension of the closed loop formed by the associated strap 24 and the crossbar 14 is adjustable.

A pad 27 is coupled to the crossbar 14 and each arm support 20 of the pair of arm supports 20. The pad 27 is positioned on the chest engagement surface 18 and the arm engagement surfaces 22. The pad 27 comprises a compressible material such that the pad 27 is configured to conform to an outer surface 56 of the user 46. The compressible material may comprise, for example, a thermoplastic elastomer foam, a rubber foam, another polymer, or the like.

A leg support 28 comprises a thigh support 30 and a calf support 38. The thigh support 30 has a pair of recesses 32 extending into an upper surface 34 of the thigh support 30. The recesses 32 of the pair of recesses 32 are laterally spaced from each other, and each recess 32 of the pair of recesses 32 is configured to receive an associated thigh 58 of a pair of thighs 58 of the user 46. The calf support 38 is coupled to and extends downwardly from a front edge 36 of the thigh support 30 wherein the leg support 28 is configured to extend over a ledge 66 of a seat 64 of an exercise machine 62. A front surface 40 of the calf support 38 is positioned such that the front surface 40 is configured to engage a pair of calves 60 of the user 46 when the pair of thighs 58 of the user 46 is positioned over the thigh support 30. The calf support 38 defines a pair of depressions 42, and the depressions 42 of the pair of depressions 42 are laterally spaced from each other. Each depression 42 of the pair of depressions 42 is configured to receive an associated calf 60 of the pair of calves 60. The calf support 38 also defines a notch 44 between the pair of depressions 42 which has a width such that the notch 44 is configured to receive a support member 68 of the exercise machine 62. The leg support 28 may comprise the thermoplastic elastomer foam, the rubber foam, another polymer, or the like.

In use, the user 46 wears the arm restraint 12 via the straps 24 on the pair of shoulders 50 of the user 46 such that the chest engagement surface 18 of the crossbar 14 lies against the user's 46 chest 48. The user 46 may position the front surface 40 of each arm 52 against the arm engagement surface 22 of an associated one of the pair of arm supports 20 to restrain the arm 52 from moving forwardly past the user's 46 chest 48. By engaging the arm supports 20 in this manner, the user 46 is able to eliminate any inadvertent swinging motion that would detract from an arm exercise, particularly a strength training exercise focused on increasing strength of the triceps such as a triceps pushdown.

The user 46 uses the leg support 28 by positioning it over the ledge 66 of the seat 64 of the exercise machine 62, which may be a leg extension machine. The user 46 sits on the seat 64 and places the thighs 58 over the thigh support 30 such that the calves 60 are positioned forwardly of the calf support 38. The user 46 may position the calves 60 to be supported by the calf support 38 as well. The leg support 28 braces the calves 60 and the thighs 58 of the user 46 from below to eliminate movements from other muscles during an exercise strengthening the quadriceps of the user 46.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A brace system comprising:

a leg support comprising:

a thigh support having a pair of recesses extending into an upper surface of the thigh support, the pair of recesses being laterally spaced from each other, each recess of the pair of recesses being configured to receive an associated thigh of a pair of thighs of the user; and a calf support being coupled to and extending downwardly from a front edge of the thigh support wherein the leg support is configured to extend over a ledge of a seat of an exercise machine, a front surface of the calf support being positioned such that the front surface is configured to engage a pair of calves of the user when the pair of thighs of the user is positioned over the thigh support, the calf support defining a pair of depressions, the pair of depressions being laterally spaced from each other, each depression of the pair of depressions being configured to receive an associated calf of the pair of calves.

2. A brace system comprising:

a leg support comprising:

a thigh support having a pair of recesses extending into an upper surface of the thigh support, the pair of recesses being laterally spaced from each other, each recess of the pair of recesses being configured to receive an associated thigh of a pair of thighs of the user; and a calf support being coupled to and extending downwardly from a front edge of the thigh support wherein the leg support is configured to extend over a ledge of a seat of an exercise machine, a front surface of the calf support being positioned such that the front surface is configured to engage a pair of calves of the user when the pair of thighs of the user is positioned over the thigh support, the calf support defining a pair of depressions, the pair of depressions being laterally spaced from each other, each depression of the pair of depressions being configured to receive an associated calf of the pair of calves, the calf support defining a notch between the pair of depressions, the notch having a width such that the notch is configured to receive a support member of the exercise machine.

* * * * *